United States Patent [19]

Black

[11] 4,321,735

[45] Mar. 30, 1982

[54] METHOD FOR FORMING A NARROW WEAVE FROM BARE ELASTOMERIC THREADS

[75] Inventor: Thomas C. Black, Middletown, Canada

[73] Assignee: J. P. Stevens and Company Inc., New York, N.Y.

[21] Appl. No.: 34,882

[22] Filed: Apr. 27, 1979

Related U.S. Application Data

[62] Division of Ser. No. 831,457, Sep. 7, 1977, Pat. No. 4,164,963.

[51] Int. Cl.[3] ..... D03D 15/04; D03D 15/08; D06C 21/00; D06C 23/04

[52] U.S. Cl. ..... 28/155; 28/156; 57/225

[58] Field of Search ..... 139/421–423, 139/1; 57/225, 226, 18.6; 428/231; 28/155, 156

[56] References Cited

U.S. PATENT DOCUMENTS

| | | | |
|---|---|---|---|
| 1,977,137 | 10/1934 | Moore | 139/421 |
| 2,384,936 | 9/1945 | Lilley et al. | 139/421 X |
| 3,099,907 | 8/1963 | Masurel et al. | 139/1 R |
| 3,315,328 | 4/1967 | Ibrahim | 28/156 |
| 3,387,448 | 6/1968 | Lathem et al. | 28/155 |
| 3,404,710 | 10/1968 | Pierce | 139/421 |
| 3,788,366 | 1/1974 | Campbell, Sr. et al. | 139/421 |

FOREIGN PATENT DOCUMENTS

| | | | |
|---|---|---|---|
| 146240 | 6/1931 | Switzerland | 139/421 |

*Primary Examiner*—James Kee Chi

*Attorney, Agent, or Firm*—Leitner, Palan, Martin & Bernstein

[57] ABSTRACT

A narrow woven stretch fabric is formed from bare elastomeric warp threads separated by high shrink warp threads and from a high shrink weft thread. The edge elastomeric warp threads are loosely wrapped with heat set yarn. These edge threads, which are under the same tension as the other elastomeric warp threads, are wrapped between the supply and the loom. The weft thread is interwoven at a low weft per inch and the fabric is heat treated to shrink the non-elastic high shrink threads and corrugate the elastomeric threads without heat setting. The wrapping device and the surface feed rollers for the elastomeric threads are driven by the loom drive at appropriate speeds.

10 Claims, 6 Drawing Figures

FIG.1
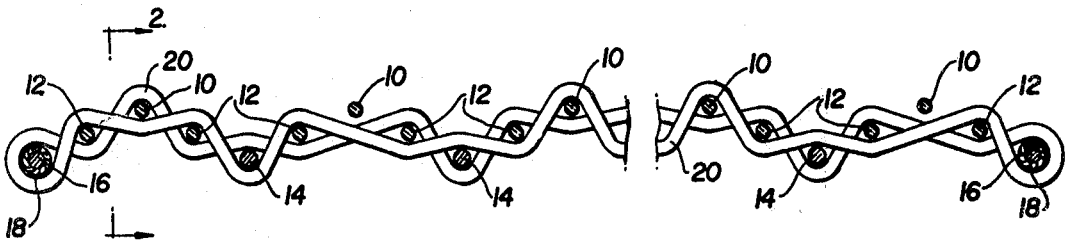
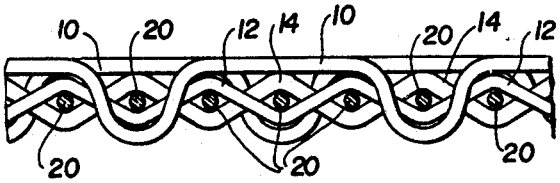
FIG.2
FIG.3
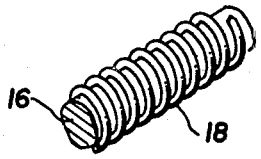
FIG.6
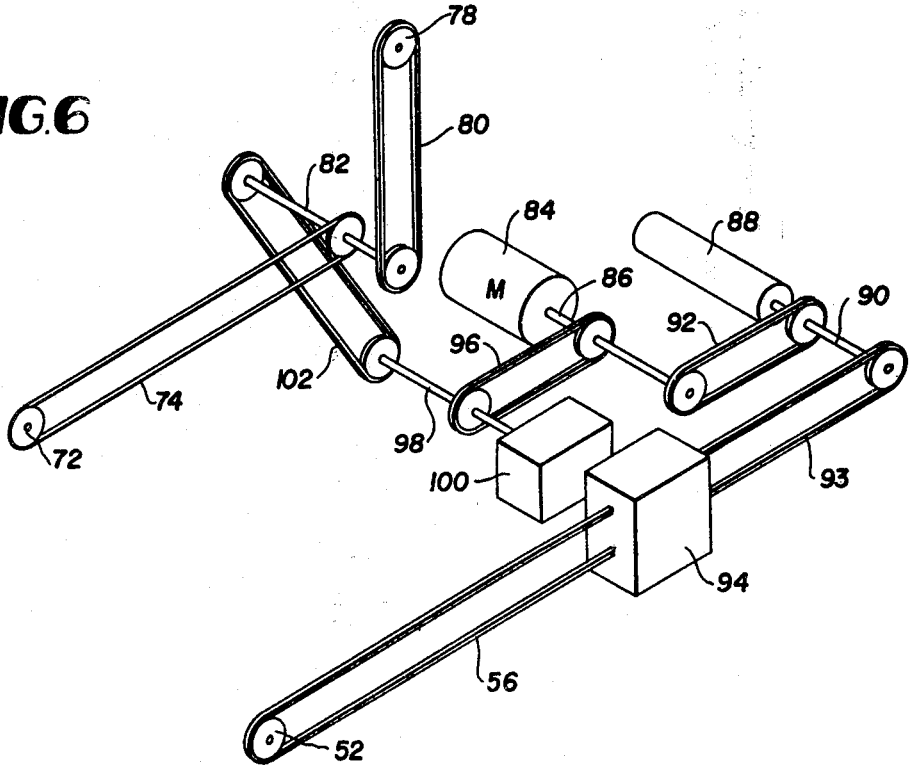

METHOD FOR FORMING A NARROW WEAVE FROM BARE ELASTOMERIC THREADS

This is a divisional of application Ser. No. 831,457, and filed Sept. 7, 1977 now U.S. Pat. No. 4,164,963.

BACKGROUND OF THE INVENTION

This invention relates generally to narrow weaves and more particularly to a shear elastomeric woven fabric and method of fabrication.

In the field of narrow bands or tapes containing elastomeric or rubber threads, the elastomeric threads are generally covered so as to retain their position in the final weave in use as well as over the lifetime of the fabric. The multiple washings over a lifetime have a tendency to cause the elastomeric threads to move relative to the remainder of the threads and thus provide an unattractive and unuseable element of a piece of apparel. By using wrapped elastomeric threads, the fabric may be formed by weaving relatively low wefts per inch, such as 30 wefts per inch. This reduction in the wefts per inch makes the woven fabrics commercially competitive in spite of the increased cost of the covered elastomeric thread.

When forming narrow bands, tapes, or straps from uncovered elastomeric or rubber threads, the number of wefts per inch must be increased to hold the bare elastomeric threads in place in the woven fabric. This generally includes weaving at 50–60 wefts per inch depending upon the density or number of ends. Though being relatively cheaper than the amount of materials being used, the increased wefts per inch increases the cost of production.

Wrapped elastomeric threads may be single or double wrapped with a second material or yarn. Single and double wrapped elastomeric yarns are generally balanced, but have a tendency when unbalanced or unstable to turn, twist, and form extending loops of the wrapped material. The unstable condition of the wrapped elastomeric yarn also causes narrow tapes formed with the elastomeric band to twist or turn or not to lie flat.

Wrapping operations are expensive since they require separate machinery to wind the threads, unwind the threads, wrap the threads, and rewind the threads, as well as space and operating time. The single and double wound elastomeric threads of the prior art are generally bulky since they are tightly wrapped to keep the elastomeric thread under tension and to counteract or restrain any twisting or buckling of the elastomeric thread. The wrapping yarn is generally twisted so as to bring forces to bear on the elastomeric yarn. It is this twisting that sets up the unstable condition of the wrapped elastomeric thread which produces the undesirable results in the final woven product.

Thus, there exists a need for making a sheer, inexpensive, narrow elastomeric fabric.

SUMMARY OF THE INVENTION

The present invention relates to a narrow woven elastic fabric and to the method and apparatus for producing the fabric. The warp of the fabric includes a plurality of elastomeric threads separated from each other by a plurality of high shrink non-elastic synthetic threads which are preferably made of nylon or polyester. The two edge warp threads are elastomeric and are loosely wrapped with a heat set yarn to increase the hold of these edge elastomeric warp threads. The edge elastomeric threads are under the same tension as the other elastomeric threads to assure the stability of the woven fabric. A high shrink synthetic weft thread is interwoven with the warp threads. The process includes the steps of providing the warp threads from a plurality of supply elements to the loom and wrapping the two edges warp elastomeric threads between the supply and the loom with texturized, heat set synthetic yarn, for example, polyester yarn. The weft is woven at a low weft count for example 25–35 wefts per inch. The non-elastic warp threads and the weft thread are preferably continuous multi-filament yarns. The final woven product is heat treated at a temperature sufficient to cause the high shrink weft and warp threads to shrink so as to further bind the elastomeric threads. The temperature is not sufficient to heat set the elastomeric threads, but the elastomeric thread assumes a corrugated shape which increases the hold of the elastomeric thread in the final woven product.

The machinery needed to provide the proper tension of the elastomeric thread from the supply elements to the loom as well as the rate of wrapping of the warp yarn includes mechanically interconnecting the drive of the loom with the drive of the wrapping device and the positive feed mechanism for the elastomeric threads. The elastomeric threads are driven or let-off the spool by interconnected or synchronous feed rollers which engage the elastomeric material on the rolls and control or synchronize let-off.

OBJECTS OF THE INVENTION

An object of the invention to provide a sheer, long-lasting, narrow elastomeric fabric, tape, or band.

Another object of the invention is to provide a narrow elastomeric fabric requiring low wefts per inch of weaving operation without reducing the life of the fabric.

A further object of the invention is to provide a method of increasing the holding of bare elastomeric threads in a narrow band weave using reduced material and work.

Still another object of the invention is to provide an apparatus capable of simultaneously wrapping and weaving elastomeric threads into a fabric.

An even further object is to provide a stable stretch fabric having covered and bare elastomeric threads.

Other objects, advantages, and novel features of the present invention will become apparent from the following detailed description of the invention when considered in conjunction with the accompanying drawings.

BRIEF DESCRIPTION OF THE DRAWINGS

FIG. 1 is a cross-sectional view of a narrow woven fabric incorporating the principles of the present invention.

FIG. 2 is a cross-sectional view of the fabric of FIG. 1 taken along lines 2—2.

FIG. 3 is a section of elastomeric thread with the polyester loosely wrapped thereon.

FIG. 6 is a diagrammatic perspective of the thread supply, wrapping device and loom drives.

DESCRIPTION OF THE PREFERRED EMBODIMENTS

Figure 4:
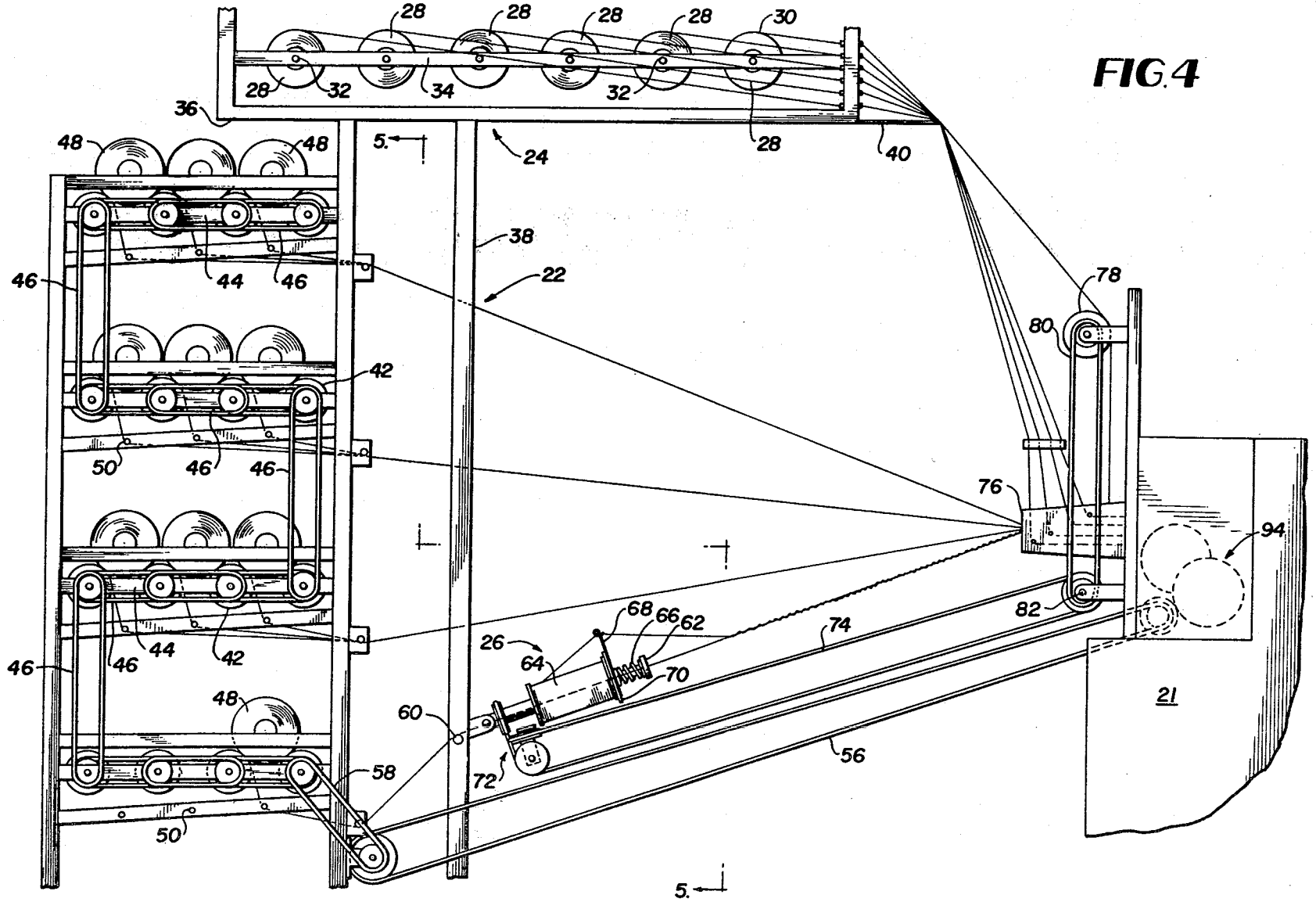
FIG. 4 is a side elevation of the interrelationship of the thread supply, wrapping device and loom.

Fabric illustrating the concepts of the present invention is illustrated in FIGS. 1 and 2. The warp is made up of a plurality of warp threads, including high shrink back threads 10, high shrink binder threads 12, bare elastomeric threads 14, and covered elastomeric edge warp threads 16. A heat set synthetic yarn 18 is loosely wrapped around the edge elastomeric warp threads 16 to increase their hold within the woven fabric. A high shrink weft thread 20 is interwoven with the warp threads. The specific fabric illustrated in FIGS. 1 and 2 includes eight back threads 10, sixteen binder threads 12, and nine elastomeric threads 14, 16. The back threads 10, as illustrated in FIG. 2, are interwoven with the weft threads 20 every fourth weft. The non-elastic warp threads 10 and 12 and weft thread 20 may be any high heat shrinkable synthetic yarn, preferably selected from nylon or polyester, and heat set synthetic wrapping yarn 18 is preferably polyester.

As will be evident from the detailed analysis of the method, it is important that the majority of the warp threads 12 and the weft threads 20 be heat-shrinkable threads to diminish the weave and increase the bind or holding power on the elastomeric threads 14 and 16. Similarly, it is essential that the wrapping thread 18 be pre-heat set so as to not be affected by the subsequent heat treatment and that the elastomeric threads 14 and 16 be capable of forming corrugations during the heating process. This is also important to increase the holding power of the fabric on the elastomeric threads.

In a specific embodiment of the present invention, the elastomeric threads 14 and 16 were spandex having a 1120 denier; the warp threads 10 and 12 were thirty-four filament 140 denier nylon, the weft thread 20 was a thirty filament 150 denier polyester, and the wrapping yarn 18 was a textured, heat set 150 denier polyester. It is considered quite desirable that the high shrink warp and weft threads be continuous filament.

By viewing the structure of FIG. 1, it is seen that the interior warp elastomeric threads 14 are bare and the exterior or edge elastomeric warp threads 16 are wrapped. The exterior elastomeric threads must be wrapped since the weft thread wrapping around the edge warp thread 16 produces a tunneling effect such that the weft threads cannot bind or hold the elastomeric edge warp thread 16 sufficiently to hold them from slipping in the fabric. A section of the wrapped elastomeric thread 16 having the heat set polyester yarn 18 loosely wrapped around it is illustrated in FIG. 3. The wrap is sufficiently tight to increase the coefficient of friction of the elastomeric thread without reducing or restricting its diameter.

The method of this invention needed to produce the novel fabric includes controlling the let-off of bare elastomeric threads as warp threads into a loom and loosely wrapping heat set yarn onto the edge elastomeric warp threads between the supply and the loom. The loose warp is possible since the elastomeric thread is under tension from its supply directly into the loom and onto the take-up roll of the loom whereas with pre-wrapped elastomeric yarn the warp must be tight to prevent curling, looping, and buckling which is present when the wrapped elastomeric thread j—wound on a supply cone and unwound in use on the loom. Also, it is difficult to use pre-wrapped elastomeric threads in combination with bare elastomeric threads because it is necessary to control the tension on the elastomeric threads during wrapping relative to the tension on the bare threads during weaving (preferably the tensions are about equal) in order to obtain a stable fabric which will lie flat. The wrapping yarn is applied without twists and consequently the resulting structure produces an elastomeric yarn which is stable and not under any twist or tension. The elastomeric warp yarns are separated by non-elastomeric heat shrinkable synthetic warp yarns, preferably made of nylon or polyester and preferably the weft yarn is interwoven therewith at a low weft per inch. Generally, a weft cannot between 25 and 35 wefts per inch is sufficient to initially hold the elastomeric yarns in position in the woven fabric on the take-up roll.

The woven fabric is then heat treated at between 140°–150° C. to shrink the heat shrinkable warp and weft threads to tighten the weave and to bind the elastomeric warp threads. With the contraction of the weave pattern, the elastomeric threads increase their corrugation or buckles. The temperatures are not sufficient to cause heat setting of the elastomeric threads. By wrapping the elastomeric threads with a heat set yarn, a further reduction of the denier of the elastomeric threads is not produced by the heat treatment. In a typical procedure, heat treatment is carried out on a Carroll calender using steam heated drums with a steam pressure of 40–50 pounds per square inch. The fabric may be treated with a wax softener and a resin prior to heat treatment to improve the hand or finish of the final woven product.

Since some of the bare elastomeric threads are being simultaneously wrapped and woven, it is essential that the let-off or feed mechanism for the elastomeric thread be synchronized with the weave or loom operations so as to provide the proper tension on the elastomeric threads during the combined operations and maintain them equal to the tension on the bare elastomeric threads. This is even more critical in a needle loom which operates at a greater rate of speed than than the standard gang looms. Although the fabric and method of the present invention has been produced on both looms, it is preferably performed on a needle loom. The apparatus as illustrated in FIGS. 4, 5, and 6 is a needle loom, for example, a Crompton & Knowles model NL-7.

Figure 5:
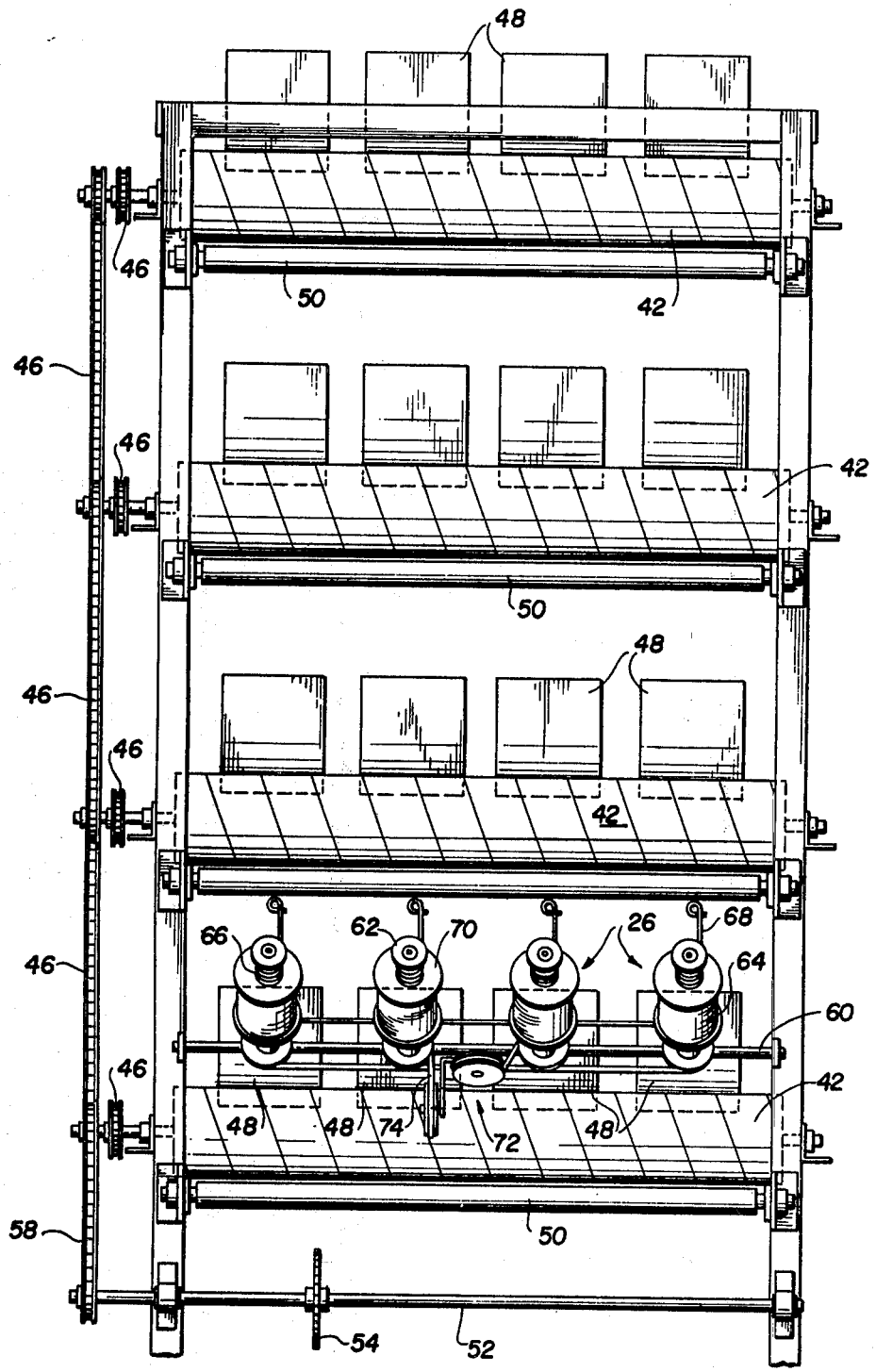
FIG. 5 is a front view of the thread supply and wrapping device taken along lines 5—5 of FIG. 4.

Mechanisms illustrated in FIGS. 4 and 5 include a loom 21, a driven creel 22, a yarn creel 24 and wrapping device 26. The yarn creel 24 includes a plurality of rolls or cones 28 of non-elastic, heat shrinkable synthetic threads for the warp threads and a cone 30 of the heat shrinkable synthetic thread for the weft thread of each fabric woven. The cones are supported on spindles 32 connected to uprights 34 which are secured to the frame 36 of the yarn creel. The frame is held above the floor by a pair of uprights 38. A guide 40 is provided at the front of frame 36 to guide or direct the warp threads into the warp of loom 21. The non-elastic warp and weft threads are let-off as needed by the tension exerted by the loom take-up roll and the shuttle or needle of the weft respectively. Tension devices, not shown, provide the desired tension on the warp threads from cones 28.

The driven roller creel 22 includes a plurality of non-slip rollers 42 including shafts whose outer ends are journalled in supports 44 and are interconnected by sprockets and chains 46. The interconnection of the drive rollers by chains synchronizes the rotation so as to drive the surface of the elastomeric threads to control or synchronize the let-off and consequently maintain equal tension on all elastomeric threads whether to be wrapped or not. A plurality of rolls of elastomeric yarn 48 are shown resting on their face between two non-slip rollers 42. The elastomeric threads leave the supply rolls 48 and traverse guide rollers 50 on their way to the loom 21. A main shaft 52 (FIG. 5) is mounted to the driven creel 22 and includes a sprocket 54 to receive chain drive 56 from the loom and is interconnected to the synchronous chains 46 of the non-slip roller drives by a chain and sprocket 58.

Between the driven creel 22 for the elastomeric threads and the loom 21 is a wrapping device 26. Mounted to support 60 are spindles 62 having bobbins 64 of the heat set wrap mounted thereon. A spring 66 biases a flyer wire 68 into a top 70. The to-be-wrapped elastomeric thread traverses the center of the wrapping device 26 or spindle 26 and has preferably a texturized heat set polyester yarn wrapped thereon by flyer wire 68. The wrapping device 26 is driven by belts and gears 72 which are interconnected to the loom drive by chain 74. Four wrapping devices 26 (without the uprights for support 60) are illustrated in FIG. 5 since loom 21 is capable of weaving two fabrics simultaneously.

As illustrated in FIG. 4, a guide frame 76 receives the non-elastic warp threads from yarn creel 24 and the elastomeric threads from the driven creel 22 to provide the warp for the loom 21. The weft thread is received by a driven roller 78 and transmitted to the needle or shuttle. Roller 78 is interconnected by chain 80 to shaft 82 which also drives the chain 74 which drives the wrapping device 26.

The interconnection of the drive of the loom and the functional element of the loom 21 with the wrapping devices 26 and the driven creel 22 for the elastomeric threads is illustrated diagrammatically in FIG. 6. The main motor 84 has a drive shaft 86. By appropriate gears the take-up roller 88 is connected to shaft 86 by its shaft 90 and chain and sprocket 92. Shaft 90 is also connected to the feed roller drive shaft 52 by chains 93, gear box 94, and chain 56. The gear box 94 is sufficient to interconnect or synchronize the drive or rotation to the take-up roll 88 and the drive for the rollers 42 for the elastomeric threads. Thus, the tension on the threads can be more uniformly controlled for wrapping and subsequent warp structure in the loom. Motor drive shaft 86 is also connected by chain and sprockets 96 to a shaft 98 which drives the shed cam mechanism 100. Also driven by shaft 98 through chain and sprockets 102 is shaft 82 which drives through chain 80 the weft roller 78 and drives through chain 74 the wrapping gear 72. Thus, the low speed take-up reel drive is used to drive the let-off for the elastomeric thread feed and the high speed shed cam drive is used to drive the high speed weft feed roller and the wrapping device.

Although FIG. 6 illustrates a mechanical synchronization of the respective drives, obviously individual motor drives may be provided using a system of electronic or electrical synchronization. Since the shed cam drive is available as well as the take-up roll drive, the mechanical implementation is considered inexpensive and provides the performance of control characteristics.

The method and apparatus of the present invention reduces the cost of manufacture by reducing the mechanical work done and the amount of materials used. By the use of synthetic elastomeric threads instead of rubber, needle cutting is eliminated and the fabric formed is shear. The use of threads of heat shrinkable material such as nylon and polyester also provide the heat characteristics desired whereby the final heat treatment shrinks these threads to tighten the weave and prevent slippage of the elastomeric threads without the use of prewrapped elastomeric threads except at the edges of the fabric. The present materials and method provide a sheer elastic band with the ability to withstand repeated washings.

From the preceding description of the preferred embodiments, it is evident that the objects of the invention are obtained, and although the invention has been described and illustrated in detail, it is to be clear that the details are intended for illustrative purposes only and are not to be taken by way of limitation. If desired for certain end uses, more elastomeric threads than the edge elastomeric threads may be wrapped between the supply and the loom. The spirit and scope of the invention are to be limited only by the terms of the appended claims.

What is claimed:

1. A process for weaving a narrow elastic fabric comprising:

providing warp threads from a continuous supply which include elastomeric warp threads separated from each other by non-elastomeric warp threads with the edge warp threads being bare elastomeric;

loosely wrapping said elastomeric edge warp threads with a warp yarn between the supply of said elastomeric threads and the weaving area to produce a uniform warp edge; and interweaving a heat shrinkable weft thread with said warp threads.

2. The process according to claim 1 wherein said weft thread is interwoven in the range of 25 to 35 wefts per inch.

3. The process according to claim 1 including the additional step of heat treating said woven fabric to shrink said non-elastomeric warp and said weft threads.

4. The process according to claim 3 wherein said heat treating is below the heat set temperature of said elastomeric threads.

5. The process according to claim 3 wherein said warp yarn is a heat set yarn unaffected by said heat treating step.

6. The process according to claim 5 wherein said heat treating is at a temperature between 140 to 150 degrees centigrade.

7. The process according to claim 1 wherein said non-elastomeric warp threads are nylon, said warp yarn and said weft thread are polyester and said elastomeric thread is spandex.

8. The process according to claim 7 wherein said nylon and said polyester threads are continuous filament.

9. The process according to claim 7 wherein said warp yarn is approximately 150 denier and is textured, heat set polyester and said weft thread is multi-filament and has a denier of approximately 150.

10. The process according to claim 1 including controlling the tension on said edge elastomeric threads relative to that on the remaining elastomeric threads.

* * * * *

UNITED STATES PATENT AND TRADEMARK OFFICE

CERTIFICATE OF CORRECTION

PATENT NO. : 4,321,735

DATED : Mar. 30, 1982

INVENTOR(S) : Thomas C. Black

It is certified that error appears in the above—identified patent and that said Letters Patent is hereby corrected as shown below:

Column 3

Line 65, after "thread" delete "j"

Column 4

Line 27, delete "40-50" and insert --40-65--

Line 39, delete "than" (second occurrence)

Column 5

Line 17, delete "26" (second occurrence) and insert --62--

Line 41, delete "to" and insert --of--

Column 6

Line 52, delete "warp" (second occurrence) and insert --wrap--

Signed and Sealed this

Tenth Day of August 1982

[SEAL]

Attest:

GERALD J. MOSSINGHOFF

Attesting Officer

Commissioner of Patents and Trademarks